respective bell-crank 72 in the counterclockwise direction, for example, to a position in which the respective guide pin 73*b* rests against the lower end of the arcuate slot 76. It is further to be noted that the guide pins 73*a* and 73*b* are of sufficient length to project inwardly beyond the inner surface of the adjacent side wall 45*a* for reception in the grooves 69 and 70 provided in the adjacent end of cassette housing 22, as hereinafter described. Further, the seat 75 provided on each side wall 45*a* is at a vertical distance from the upper surface of base 45*b* that is slightly larger than the vertical distance from the bottom of cassette housing 22 to the lower margins of the grooves 69 and 70 provided in the opposite ends of the cassette housing.

As shown particularly in FIGS. 9, 10 and 12, a lock releasing device is provided on holder 45 for releasing the latch pin 66 from keeper opening 67*a* when cassette 21, in moving toward its operative position on the holder, arrives at the position where opening of the lid 63 is initiated, as hereinafter described in detail. Such lock releasing device is shown to include a leaf spring 78 fixedly secured, at one end, to the outer surface of the side wall 45*a* which is adjacent the end of the cassette having the latch provided therein, and a roller 77 rotatably carried by the free end of spring 78 and being normally urged by the latter through an opening in the adjacent side wall 45*a*, for example, to the position indicated in broken lines on FIG. 9. The above described mechanism 61 operates as follows:

With the cassette 21 initially having its lid 63 in the closed position thereof, the cassette is horizontally inserted into holder 45 in the direction of the arrow *c* on FIG. 10 so as to slide over base 45*b* in the direction toward the stop 79, and with the lid 63 at the foremost side of the inserted cassette. During the initial insertion of the cassette in holder 45, guide pins 73 are led into grooves 70 by the flared ends 70*a* of such grooves and are raised from the lower ends of the respective arcuate slots 76 against the forces of the springs 74 acting on bell-cranks 72. As the cassette 21 nears the position shown on FIG. 10, the roller 77 which has been previously rolling along the surface of the adjacent end wall of cassette housing 22 enters opening 67*b* and is urged by spring 78 against projection 68 so as to overcome the force of spring plate 65 and thereby urge the latter to flex inwardly to the position shown in broken lines on FIG. 9, with consequent removal of the latch pin 66 from keeper opening 67*a*, whereby to permit the commencement of the opening of lid 63.

Of course, at the point where the latch or lock for lid 63 is released, as described above, the guide pins 73*b* on bell-crank 72 are engaged in grooves 69 and, by reason of the springs 74 acting on bellcrank 72, guide pins 73*b* act downwardly in grooves 69 for holding the cassette housing 22 downwardly against base 45*b*. Further, simultaneously with the release of the latch or lock for lid 63, guide pins 73*a* resting against the respective seats 75 are led into grooves 70 at the flared ends 70*a* of such grooves. By reason of the previously described location of seats 75 relative to the surface of base 45*b*, the entry of guide pins 73*a* into grooves 70 causes slight upward pivoting of lid 63 about the pivot pins 64, for example, to the position shown on FIG. 10. Such initial upward pivoting of lid 63 is effective to displace the keeper opening 67*a* out of registration with the latch pin 66 so that, as the horizontal movement of cassette 21 toward its operative position continues and roller 77 no longer acts on projection 68, the latch pin 66 cannot return to its locking position within keeper opening 67*a*.

As the horizontal movement of cassette 21 toward its operative position continues beyond the position illustrated on FIG. 10, the inclined grooves 70 receiving guide pins 73*a* act upon the latter to cause clockwise swinging of levers 71 against the forces of the respective springs 74. Thus, when cassette 21 attains its operative position against stop 79, as shown on FIG. 12, the cooperative action of pins 73*a* in slots 70 is effective to dispose such slots 70 substantially in vertical directions, with the lid 63 being pivoted to its fully open position for exposing the opening 28 of the cassette housing. It will be apparent that, with cassette 21 in its operative position and arms 71 extending substantially vertically from their respective pivot pins 71*a*, the respective springs 74 are elongated so as to exert increased forces on bell-cranks 72 by which the guide pins 73*b* act strongly downward in the respective grooves 69. Thus, when in its operative position, the cassette housing is strongly held against base 45*b* of holder 45.

When it is desired to remove cassette 21 from its operative position within holder 45, the cassette is merely moved horizontally toward the left, as viewed on FIG. 12, that is, in the direction opposed to that indicated by the arrow *c*. During such horizontal removal of the cassette from holder 45, the engagement of guide pins 73*a* in grooves 70 is effective to return lid 63 to its closed position covering opening 28 and, upon the return of lid 63 to its closed position, latching pin 66 is again urged by spring plate 65 into the keeper opening 67*a* for locking or latching the lid 63 in its closed position.

It will be apparent from the above that, in a cassette-type recording and/or reproducing apparatus having a tape loading and unloading device and cassette holder according to this invention, the cassette 21 can be very easily moved in the horizontal direction to and from its operative position in the holder without interference from either the tape engaging members of the tape loading and unloading device or from the reel drive members which are engageable with the take-up and supply reels of the cassette in the operative position of the latter.

Although an illustrative embodiment of this invention has been described in detail herein with reference to the accompanying drawings, it is to be understood that the invention is not limited to that precise embodiment, and that various changes and modifications may be effected therein by one skilled in the art without departing from the scope or spirit of the invention as defined in the appended claims.

What is claimed is:

1. In a magnetic recording and/or reproducing apparatus that includes a cylindrical tape guide drum with at least one rotary magnetic head moved in a circular path substantially coinciding with the periphery of said drum, a cassette holder spaced from said guide drum for receiving and positioning a tape cassette having a housing with an access opening and containing a magnetic tape which is wound on reels within the housing and extends between the reels across said opening, and a tape loading and unloading device comprising an annular support means rotatable around said drum between first and second positions in an arcuate path that is substantially planar and extends adjacent said holder, and tape engaging means mounted on said support means so as to extend substantially normal to the Fig. 1
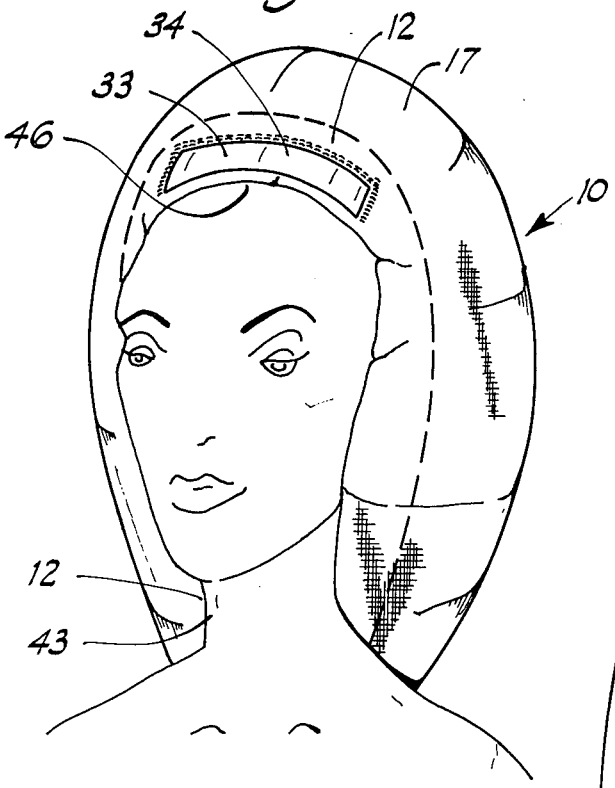
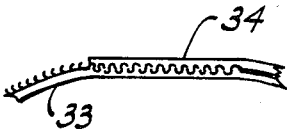
Fig. 3
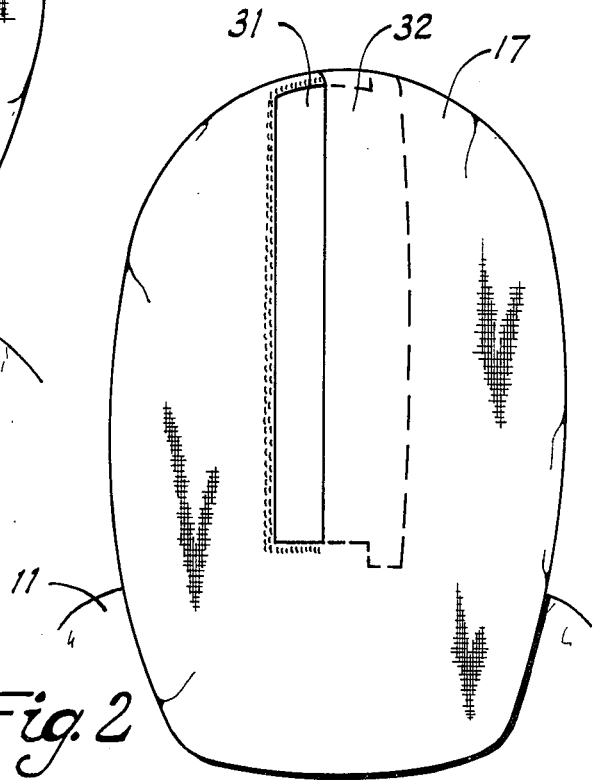
Fig. 2
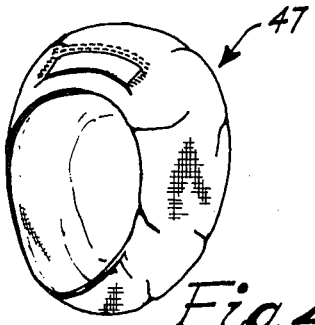
Fig. 4
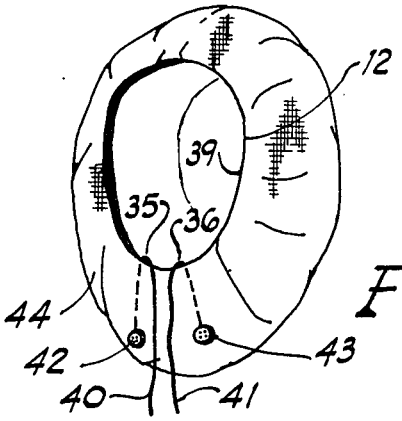
Fig. 5
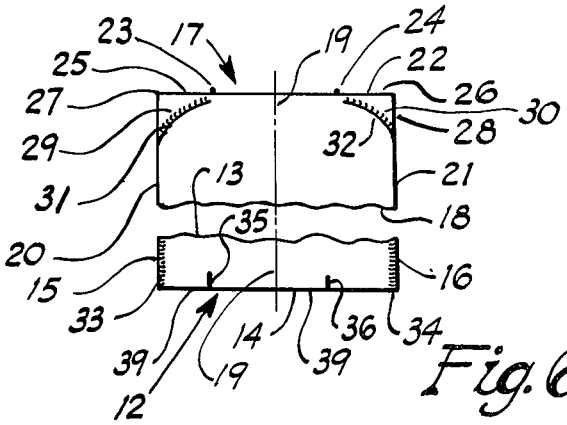
Fig. 6

HEAD TURBAN

SUMMARY OF THE INVENTION

My invention relates to a unique and novel head turban allowing a woman's hair to be confined before or after washing or while resting.

A number of head turban assemblies have been employed as illustrated in U.S. Pat. Nos. 1,749,340; 2,817,090; 3,111,679; and 3,587,114, but these aforementioned patents involve additional fasteners or elastic thread means for maintaining the head turban in an assemblied relationship, wherein my present invention is of simple design as compared to the aforementioned patents.

Accordingly, it is an object of my present invention to provide a head turban capable of size adjustment for different size heads.

A further object of my present invention is to provide a head turban with an exterior ornamental design, wherein the turban can be worn by a woman at social functions.

A still further object of my present invention is to provide a head turban of sufficient length to accommodate long hair without twisting of the hair.

Another object of my invention is to provide a head turban capable of retaining the person's body heat within the inner confines of the head turban.

Briefly, my present invention comprises a one piece unit having VELCRO tab assemblies allowing for size adjustment at the widow's peak of the head as well as the rear top portion of the head. A tie string assembly permits a band portion of the head turban to tightly engage the nape of the neck, wherein the band extends upward over the ears and onto the widow's peak portion of the head.

BRIEF DESCRIPTION OF THE DRAWINGS

The objects and features of the invention may be understood with reference to the following detailed description of an illustrative embodiment of the invention, taken together with the accompanying drawings in which:

FIG. 1 illustrates a front view of the turban on a person's head;

FIG. 2 illustrates a rear view of the turban;

FIG. 3 illustrates a side view of a VELCRO tab assembly of the turban;

FIG. 4 illustrates a side perspective view of an inner shell member used in conjunction with the turban;

FIG. 5 illustrates a front perspective view of the turban; and

FIG. 6 illustrates a top planar view of the components from which the turban is formed.

DESCRIPTION OF THE PREFERRED EMBODIMENT

Turning now descriptively to the drawings, in which similar reference characters denote similar elements throughout the several views, FIG. 1 shows an improved head turban 10 worn on the head 11 of a user, wherein the size of the turban 10 can be conveniently adjusted to accommodate various head sizes.

The formation of the head turban 10 from its component parts is shown in FIG. 6. A first narrow elongated rectangular shaped cloth member 12 has a top 13 and a bottom 14 horizontal edge and a left 15 and a right 16 vertical end. A second wider elongated rectangular shaped cloth member 17 of an equal length to member

12 is sewn along its bottom edge 18 to the top edge 13 of member 12. The combination of members 12, 17 is laterally folded in half along a lateral center line 19, wherein the bottom half of the left 20 and right 21 ends of member 17 are sewn together leaving the top half of the ends 20, 21 unsewn. The top edge 22 of folded member 17 is sewn together from the center line 19 to midway points 23, 24 to each end 20, 21 of member 17 leaving the outer portion 25, 26 of the top edge 22 unsewn from the midpoints 23, 24 to the ends 20, 21. Alternatively, the corner of folded member 17 at the top of center line 19 can be cutaway into smooth broad radii from the midway points 23, 24 of top edge 22 to the midpoint of center line 19 of member 17. Member 17 is sewn together from the midpoint of center line 19 along the cutaway to midway points 23, 24 of the top edge 22. The top left 27 and right 28 corners of member 17 are cutaway on lines 29, 30 into smooth broad radii. First VELCRO tabs 31, 32 are affixed along each top half of the ends 20, 21, lines 29, 30 and the outer portions 25, 26 of the top edge 22. Second VELCRO tabs 33, 34 are affixed along each end 15, 16 of member 12. The bottom edge 14 of member 12 has a hem 39 with a slot opening 35, 36 at a midpoint between the center line 19 and each end 15, 16 of member 12. Tie strings 37, 38 are sewn within hem 39 at each end 15, 16; wherein the free ends 40, 41 of the tie strings 37, 38 extend outward through openings 35, 36. A button member 42, 43 is affixed onto the back face 44 of member 12, below the openings 35, 36 as shown in FIG. 5.

In use, the center of member 12 is placed against the nape of the neck 45 with the member 12 extending upward over the ears with the VELCRO tabs 33, 34 at the ends 15, 16 of member 12 communicating with each other at the widow's peak 46 of the head 11 as shown in FIGS. 1, 3.

The second member 12 covers the back portion of the head as shown in FIG. 2. The first VELCRO tabs 31, 32 are joined together forming a closed back portion of the turban 10.

FIG. 5 shows the tie string members 37, 38 pulled taut to be tied around button members 42, 43 causing member 12 to tightly engage the head 11 of the user.

FIG. 4 shows an inner cloth shell member 47 fitting under the head turban 10, wherein the dimensions of the member 47 conform to the inner dimensions of the head turban 10.

Hence, obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A method of forming a head turban used for a person's head, which comprises:

a. forming a first elongated rectangular shaped member having a top and a bottom horizontal edge and a left and a right vertical end;

b. forming a second wider elongated rectangular shaped member having a top and a bottom horizontal edges and a left and a right vertical end, wherein said first member equals said second member in length;

c. sewing said top edge of said first member to said bottom edge of said second member;

d. folding in half said first and said second members as sewn together on a lateral center line;

e. sewing together a bottom half of said right and said left ends of said second member leaving unsewn a top half of said right and said left ends of said second member;

f. sewing together each side of said top edge of said second member from said center line to points midway between said center line and said left and said right ends of said second member leaving unsewn an outer portion of said top edge at said left and said right ends;

g. cutting away along smooth broad radii a top left and a top right corner of said second member;

h. securing first VELCRO tabs along each said outer portion of said top edge, each said cutaway corner, and each said unsewn top half of said left and said right ends of said second member; and i. securing a second VELCRO tab along each said left and right ends of said first member.

2. The method as recited in claim 1, further comprising sewing a hem along said bottom edge of said first member.

3. The method as recited in claim 2, further comprising cutting a slot opening in said hem at points between said center line and said right and said left ends of said first member.

4. The method as recited in claim 3, further comprising securing a tie string in each end of said hem, wherein a free end of each tie string extends outward through said slot opening of said hem.

5. The method as recited in claim 4, further comprising securing a pair of button members to the back face of said first member.

6. The method as recited in claim 5, further comprising:

a. placing said first member onto the nape of the neck, extending upward over the ears and securing said second VELCRO tabs together at the widow's peak of said person's head; and b. joining together said second VELCRO tabs behind the top rear portion of said person's head.

7. The method as recited in claim 6, further comprising:

a. pulling taut said tie string members while said first member engages said head; and b. securing a free end of each said tie string to said button members.

8. The method as recited in claim 5, further comprising placing a cloth inner shell member between said head and said head turban.

9. A head turban used on a person's head, which comprises:

a. a first elongated rectangular shaped member having a top and bottom horizontal edge and a left and right vertical end;

b. a second wider elongated rectangular shaped member having a top and bottom horizontal edge and a left and right vertical edge;

c. said bottom edge of said second member joined to said top edge of said first member;

d. said first and said second members as joined together folded in half along a lateral center line;

e. the bottom half of said left end of said second member affixed to a bottom half of said right end of said second member;

f. a portion of said top edge of said second member extending from said center line halfway to said left end affixed to a second portion of said top edge of said second member extending from said center line halfway to said right end;

g. first VELCRO tabs affixed to said left and said right vertical ends of said first member; and h. second VELCRO tabs affixed to the top half of said left end and the outer left end of said top edge of said second member, as well as to the top half of said right end and the outer right end of said top edge.

* * * * *